US010926317B2

(12) United States Patent
Masbate et al.

(10) Patent No.: US 10,926,317 B2
(45) Date of Patent: Feb. 23, 2021

(54) CASTING METHOD

(71) Applicants: ILUKA RESOURCES LIMITED, Perth (AU); University of Northern Iowa Research Foundation, Cedar Falls, IA (US)

(72) Inventors: Jorge Masbate, Perth (AU); Gerard Thiel, Cedar Falls, IA (US); Sairam Ravi, Cedar Falls, IA (US)

(73) Assignees: ILUKA RESOURCES LIMITED, Perth (AU); University of Northern Iowa Research Foundation, Cedar Falls, IA (US)

( * ) Notice: Subject to any disclaimer, the term of this patent is extended or adjusted under 35 U.S.C. 154(b) by 0 days.

(21) Appl. No.: 16/343,097

(22) PCT Filed: Oct. 18, 2017

(86) PCT No.: PCT/AU2017/051127
§ 371 (c)(1),
(2) Date: Apr. 18, 2019

(87) PCT Pub. No.: WO2018/071968
PCT Pub. Date: Apr. 26, 2018

(65) Prior Publication Data

US 2020/0047242 A1 Feb. 13, 2020

Related U.S. Application Data

(60) Provisional application No. 62/409,504, filed on Oct. 18, 2016.

(51) Int. Cl.

| | |
|---|---|
| ***B22C 1/02*** | (2006.01) |
| ***B22C 9/02*** | (2006.01) |
| *B22C 9/10* | (2006.01) |

(52) U.S. Cl.
CPC ..... *B22C 1/02* (2013.01); *B22C 9/02* (2013.01); *B22C 9/10* (2013.01)

(58) Field of Classification Search
CPC .... B22C 1/00; B22C 1/02; B22C 9/02; B22C 9/10
See application file for complete search history.

(56) References Cited

U.S. PATENT DOCUMENTS

| | | | | |
|---|---|---|---|---|
| 5,223,051 | A | 6/1993 | Ryntz, Jr. | |
| 10,328,484 | B2 * | 6/2019 | Thiel | B22C 1/02 |
| 2007/0099793 | A1 | 5/2007 | Wilson | |

FOREIGN PATENT DOCUMENTS

| | | | |
|---|---|---|---|
| JP | 2013188789 | A | 9/2013 |
| WO | 2018071968 | A1 | 4/2018 |

OTHER PUBLICATIONS

International Search Report and Written Opinion of PCT/AU2017/051127, dated Dec. 11, 2017, 8 Pages.

* cited by examiner

*Primary Examiner* — Kevin P Kerns
*Assistant Examiner* — Steven S Ha
(74) *Attorney, Agent, or Firm* — Nixon Peabody LLP; Linda B. Huber

(57) ABSTRACT

A method of casting an article from a molten metal including: admitting molten metal to a mould formed from a foundry sand comprising a blend of silica sand and a zircon aggregate, the zircon aggregate exhibiting a sharp rise in linear thermal expansion coefficient in a temperature band above 1200° C. and up to 1600° C.; and cooling the mould and molten metal to solidify the molten metal and form a cast article, wherein one or more surfaces of the mould, or of a portion of the mould, in contact with the molten metal are uncoated.

15 Claims, 13 Drawing Sheets

CASTING METHOD

CROSS-REFERENCE TO RELATED APPLICATIONS

This application is a National Phase of International Application No. PCT/AU2017/051127 filed Oct. 18, 2017, which designated the U.S. and that International Application was published under PCT Article 21(2) in English, which also includes a claim of priority under 35 U.S.C. § 119(e) to U.S. provisional patent application No. 62/409,504 filed Oct. 18, 2016, the entirety of which is hereby incorporated by reference.

FIELD OF THE INVENTION

The invention relates generally to a casting method using an uncoated mould or core formed from foundry sand comprising a blend of silica sand and a zircon aggregate.

BACKGROUND OF THE INVENTION

Silica sand is the most widely used aggregate in the foundry industry for forming moulds and cores for metal casting processes. Due to the abundance of silica sand, it is low cost and therefore provides an economically attractive option to metal casters. However, steel and iron castings in silica sand moulds tend to exhibit defects such as veining, fins, surface penetration and dimensional inaccuracy.

These defects occur, in part, due to the large thermal expansion of silica sand. Previous studies into the high temperature properties of silica sand have addressed the technical limitations metal casters face while using silica sand moulds. Silica sand undergoes various phase transitions while being heated up to high temperatures.

At temperatures of 570° C. (1058° F.) the silica sand undergoes a phase transformation from an alpha phase to a beta phase (alpha-beta transition). This alpha-beta transition is associated with a high peak expansion which causes dimensional inaccuracy in steel castings. The dimensional accuracy of castings depends on various factors such as section thickness of the casting, temperature and expansion and does not exhibit a linear trend as per the patternmaker's shrink rule.

Once past the alpha-beta phase transition at approximately 570° C. (1058° F.), silica sand experiences a steady contraction till the cristobalite phase transition at 1470° C. (2678° F.). Various sand additives such as iron oxide or Engineered Sand Additives (ESA) are used in the metal casting industry to either induce a tridymite transition, which leads to a secondary expansion, or induce the cristobalite transition at a lower temperature, which causes a large secondary expansion. These additives cause large changes in the volume of bonded sand.

Veining defects in silica sand are caused by the loss of strength on the surface of the moulds, which leads to a network of cracks arising from the high thermal expansion of the sand. These cracks are then filled by the liquid metal thereby form veins on the surface of the casting.

In addition to the above-mentioned defects arising from thermal expansion of silica sand moulds, the high temperatures also give rise to physicochemical reactions resulting in the cast article having further surface defects, such as penetration. Penetration is caused by chemical reaction between the mould and the molten metal, and results in the cast article having a surface that appears rough or uneven.

Furthermore, sand moulds and cores generally have a high degree of porosity which can become filled with molten metal during casting.

To address the above mentioned issues, certain additives may be blended with the silica sand before forming a mould or core. These additives promote the sintering of the surface of the mould or core and form a partially melted surface during casting. This causes an increase in the rigidity of the surface due to the increase in the viscosity of the sintered surface. The increase in viscosity at higher temperatures leads to higher strengths on the surface of the mould, resulting in reduced mould distortion.

Additionally refractory coatings can be applied to the mould to further reduce surface defects in the cast article. Refractory coatings (also known as refractory lining or wash; or foundry coating, lining, or wash) are used to coat surfaces of moulds or cores that contact molten metal during a metal casting operation. Refractory coatings are used as they provide a number of benefits during the casting process, and to the cast article. By way of example, refractory coatings can be used to control heat transfer characteristics during casting (such as to provide desired thermal characteristics and behaviour at the core/mould surface and metal melt interface) which affects the microstructure in the casting, and/or to prevent certain defects in the casting, and/or to improve the surface finish of a casting.

In particular, refractory coatings are useful with moulds formed from silica sand. In such cases, the refractory coating can act as a barrier between the molten metal and the surface of the sand mould or core, and prevent or minimise veining and penetration that can occur with silica sand moulds. Furthermore, the refractory particles in the refractory coatings tend to fill pores in silica sand moulds or cores, resulting in a smoother surface on the cast article.

A refractory coating is typically applied to the surface in the form of a suspension that includes a refractory mineral, a carrier, a binder, and a suspending agent. The suspension may include further additives to modify or improve the characteristics of the refractory coating if desired, such as for special applications. Once the suspension has been applied to the surface of the mould or core, the carrier evaporates to leave behind the refractory mineral, and other constituents, to form the refractory coating. Typically, a dried refractory coating includes 90-95 wt % refractory mineral, and 10-5 wt % binder, suspending agent, and other additives.

The refractory mineral determines the resistance of the refractory coating to the molten metal and determines the effect of the coating on the casting properties. The selection of the refractory mineral depends on numerous parameters including: the type of molten metal, the temperature at which the molten metal is poured, the cross sectional areas of casting, the resistance of the refractory mineral to metal penetration, the peel characteristics of the coating, and the thermal properties of the refractory mineral. Refractory minerals include plumbago, silica, graphite, coke, anthracite, zircon flour, magnesite, Chalmette, olivine, clays, talc, chromite, alumina, and mica.

The carrier (also referred to as a reducer, solvent, or vehicle) is the liquid phase of the coating. The carrier provides a medium within which the constituents of the suspension can be transferred to the surface of the mould or core. The carrier may be water or an organic solvent. Typical organic solvents include isopropyl alcohol, methanol, or naptha. Coating suspensions that include an organic solvent carrier are typically referred to as light-off coatings.

The binder acts to bind the refractory particles together to form the refractory coating. The binder also helps to bind the refractory particles to the surfaces of the mould or core after the suspension is applied. Typical binding agents include acrylics, starches, and wood derived resins.

The suspending agent acts to maintain the refractory particles in suspension, i.e. to prevent settling and/or agglomeration of the refractory particles, particularly during storage or transport. The suspending agent can also be used to modify the viscosity of the suspension which affects the manner in which the coating can be applied. Typical suspending agents include clays, polymers, and gums.

There are a number of different types of coatings that may be selected based on the casting system, and/or desired properties of the coating. However, these may be broadly grouped according to the carrier as water based coatings and light-off coatings.

The advantages of using water as the carrier are that it is low cost, non-toxic, and non-flammable. However, heat is required to evaporate the water which generally requires the coated mould or core to be oven dried (which requires additional equipment and labour). Further issues include: a greater tendency than light-off coatings for tears or runs to form in the coating, it can be time consuming and difficult to fully dry the coating depending on the geometry of the mould or core, and the use of a water carrier can result in a reduction in the tensile strength of moulds or cores formed from silicate sands.

The advantages of using a light-off coating having an organic solvent carrier (such as isopropyl alcohol), are that these are typically fast drying, have good wetting properties, provide good penetration into sand (in the case of moulds or cores formed from a foundry sand), retard moisture absorption, and don't require ovens for drying (thus lowering labour and equipment costs). However, care needs to be taken with these, such as during storage, as organic solvents are potentially toxic and flammable. Furthermore, the use of light-off coatings can result in blistering of the coating, and degradation of moulds and cores by hot burning solvents and by excessive solvent penetration.

Notwithstanding the above advantages and disadvantages, there are a number of problems generally associated with the use of foundry coatings including:

(a) Residual refractory coating elevates the malfunction risks in critical equipment and systems where the cast article will be used. Examples are safety critical automotive components in automotive, aerospace and medical systems.

(b) Inability to fully assure consistent coating coverage in complex castings, especially those with hard-to-reach internal surfaces. With the emergent and greater application of 3D printing in sand-casting, moulds and cores with greater complexity can now be prepared, as compared to conventional mould and cores preparation.

(c) The need to apply coatings adds substantial cost, manpower effort, factory space and time. For instance, application of refractory coating requires slurry preparation, application and drying equipment as part of the process, hence takes up substantial additional factory space and lengthens the time to complete production runs; manpower is needed to apply, dry and inspect the coatings, hence requires manpower cost; and thermal input is needed to dry the coatings (at least for the aqueous coatings), which incurs higher energy cost. In many instances, several layers of coating are required, which has a multiplying effect on the operational costs.

(d) Application of refractory coatings exposes the foundry process to other potential casting defects, some of which are described below:

- coating retention after shakeout—which are localised refractory materials that remain on the casting surface due to incorrect coating selection, or by ineffective blasting process;
- spalling—irregularly raised imperfections on the surface of the cast article usually accompanied by inclusions due to non-ideal coating parameters;
- excess coating—puddled areas of coatings that result in dimensional inaccuracies;
- cratering/fish eyes/bubbles—raised or depressed imperfections, due to air entrainment in coatings as a result of non-ideal proportions of wetting agent/surfactant and defoamers in the coating suspension;
- brush marks—surface imperfections due to coating method irregularities (brushing defects), high solids content, high viscosity of mixture, and/or excessive time interval between coating layer applications;
- scabs (inclusions)—formed from breakage of loose coatings that leave multiple surface defects (flaking) due to failure of the coating to adhere to the mould or core, and/or excessive intervals between coating application and drying, Given the above, although the use of refractory coatings provides a number of benefits to the casting process, their use also results in a number of problems. These problems are further exacerbated by the increasing need of end-users for high-integrity casting components and systems with zero coating residue, and the advent of tools available to facilitate preparation of complex moulds and cores, such as 3D sand printing.

In view of this, there has been considerable research into the composition of the refractory coating, the use of different refractory materials, and size of refractory particles to minimise these deleterious effects.

It is an object of the present invention to address the difficulties encountered with foundry sands formed from silica sand in a manner that achieves improved castings at an acceptable cost.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

The present invention starts from a realisation that a refractory coated mould or core formed from a foundry sand blend of silica sand and a proportion of particular zircon aggregates resulted in metal castings of improved quality compared to those cast in silica sand alone. This was first disclosed in Ravi et al., "The Use of Specialty Sand Blends to Improve Casting Quality and Reduce Costs", 71 World Foundry Congress, Advanced Sustainably Foundry, 19-21 May 2014, Palacio Euskalduna, Bilbao, Spain. The inventors subsequently found that these particular zircon aggregates, unlike other zircon aggregates, exhibit a sharp rise in linear thermal expansion coefficient in a temperature band above 1200° C. and up to 1600° C. This is the discussed in U.S. patent application Ser. No. 15/093,535.

In a departure from standard casting techniques, the inventors have now found that the improvement in casting quality is such that the casting process can be conducted without a refractory coating on surfaces of a mould or core formed from the foundry sand blend that contact molten metal.

The invention accordingly provides, in a first aspect, a method of casting an article from a molten metal including: admitting molten metal to a mould formed from a foundry sand comprising a blend of silica sand and a zircon aggregate exhibiting a sharp rise in linear thermal expansion coefficient over a temperature band above 1200° C. and up to 1600° C.; and cooling the mould and molten metal to solidify the molten metal and form a cast article, wherein one or more surfaces of the mould, or of a portion of the mould, in contact with the molten metal are uncoated.

The invention also provides, in a second aspect, a method of casting an article from a molten metal including: forming a mould for the article from a foundry sand comprising a blend that includes silica sand and a zircon aggregate exhibiting a sharp rise in linear thermal expansion coefficient over a temperature band above 1200° C. and up to 1600° C.; admitting molten metal to the mould; and cooling the mould and molten metal to solidify the molten metal and form a cast article, wherein one or more surfaces of the mould, or of a portion of the mould, in contact with the molten metal are uncoated. Preferably, in this aspect, the method additionally includes sourcing and/or supplying a zircon aggregate that exhibits the sharp rise in the linear thermal expansion coefficient.

The term mould is intended to refer to a structure for forming a casting from a molten metal. The mould has internal surfaces that define a hollow or cavity for receiving the molten metal, and imparting a desired shape during solidification of the molten metal to form the casting. The mould may be in the form of an enclosed cavity into which the molten metal is poured. The mould may include portions, such as cores, that project within, or are disposed within, the cavity to create openings within the casting, or to provide specific structures within the casting. In view of this, the portion of the mould may be an internal surface of the mould, a projection within the mould, or a core. The mould may be formed of plural co-operable segments.

By uncoated it is meant that the respective surface(s) of the mould or mould portion (for example, the core) is not coated with a refractory material (such as one which is different from the foundry sand used to form the mould) on the surfaces of the mould or core that contact molten metal during the casting process.

In one embodiment, surfaces of the mould that contact the molten metal, such as during the step of cooling the mould and molten metal, are uncoated surfaces. Preferably, all of the internal surfaces of the mould are uncoated. More preferably, the mould is an uncoated mould. Alternatively, or additionally, the portion of the mould is a core, and the surfaces of the core that contact the molten metal, such as during the step of cooling the mould and the molten metal, are uncoated surfaces. Preferably, the core is an uncoated core.

The inventors have found that use of a foundry sand including zircon, wherein the zircon exhibits a sharp rise in linear thermal expansion coefficient in the defined temperature band, provides an excellent surface finish on a cast article even in the absence of a refractory coating. Without wishing to be bound by theory, the inventors attribute this to the strong non-wettability of the zircon particles imbibed in the foundry sand, acting in conjunction with the effects of high surface strength achieved at high temperatures (due to the sharp rise in linear thermal expansion coefficient).

In an embodiment the molten metal is admitted to the mould with a temperature that is at or above 1200° C. Preferably, the molten metal is admitted to the mould at a temperature that is up to 1600° C.

In an embodiment, the sharp increase in the linear thermal expansion coefficient is at least 0.008 in/in. Preferably, the increase is at least 0.010 in/in. More preferably, the increase is at least 0.015 in/in. Most preferably, the increase is at least 0.020 in/in.

In an embodiment, the increase in the linear thermal expansion coefficient occurs over a temperature band above 1200° C. and up to 1500° C. Preferably, the temperature band is above 1250° C. More preferably, the temperature band is above 1300° C. Most preferably, the temperature band is above 1350° C. Similarly, it is preferred that the temperature band is up to 1460° C. More preferably, the temperature band is up to 1450° C.

In an embodiment, the zircon aggregate is such that the foundry sand blend exhibits a reduced magnitude of the linear thermal expansion coefficient at the alpha-beta silica phase transition, and/or the cristobalite silica phase transition commences at a lower temperature, in both cases compared to silica foundry sand.

In one form, the foundry sand blend exhibits a reduced magnitude of the linear thermal expansion coefficient at the alpha-beta silica phase transition compared to silica foundry sand. Preferably, the foundry sand blend exhibits a peak or maximum linear thermal expansion value of less than 0.012 in/in over a temperature range of from 550° C. to 600° C. More preferably, the peak or maximum linear thermal expansion value is less than 0.011 in/in.

In an alternative or additional form, the cristobalite silica phase transition commences at a lower temperature compared to silica foundry sand, such as at a temperature below 1460° C., preferably below 1450° C., and more preferably below 1440° C. Although the foundry sand blend exhibits a marked contraction, from the alpha-beta phase transition to the cristobalite phase transition, since the cristobalite phase transition is occurring at a substantially lower temperature, e.g. at a temperature within the range of 1200° C. to 1460° C., the large secondary expansion occurs at a lower temperature, thereby negating the strain on the surface of the core at the high temperatures seen in e.g. steel and iron castings. This provides a secondary increase in strength on the surface of the core, preventing cracks from forming on the surface and hence, reducing veining defects in the cast article.

In an embodiment, at the point of the silica phase transition to the cristobalite silica phase, the foundry sand exhibits a local minimum in the linear thermal expansion value. For silica foundry sand, this value is over 0.008 in/in. However, the addition of the zircon aggregate reduces this value. Preferably, the foundry sand exhibits a local minimum in the linear thermal expansion value of less than 0.008 in/in, more preferably less than 0.007 in/in, and even more preferably less than 0.006 in/in. In one form this local minimum in the linear thermal expansion value occurs at a temperature within the range of 1200° C. to 1460° C.

In an embodiment, the proportion of the zircon aggregate in the blend is in the range of from 5 wt % up to 40 wt %. Preferably the proportion of zircon aggregate in the blend is from 6 wt %, more preferably from 7 wt %, and most preferably from 7.5 wt %. Alternatively or additionally, it is preferred that the proportion of zircon aggregate in the blend is up to 30 wt %, more preferably up to 25 wt %, and most preferably up to 15%.

The optimum proportion of zircon aggregate is dependent on a balance between the increasing cost of a higher proportion and the degree of increased benefit. For example, increasing zircon aggregate steadily lowers the temperature at which the cristobalite phase transition commences, but the increased cost may produce only marginal benefit. In fact, it is found that veining and penetration tendencies are both slightly higher at 20% or 30% zircon aggregate than 10% zircon aggregate, primarily in to thicker casting sections: this suggests that the optimum proportion of zircon aggregate may vary according to the shape and/or dimensions of the article to be cast.

Without wishing to be bound by theory, the inventors are of the view that the observed sharp rise in linear thermal expansion coefficient of the selected zircon aggregate in a temperature band above 1200° C. may be related to an observed relatively higher proportion of a combination of $Fe_2O_3$, $TiO_2$ and $Al_2O_3$ in the zircon aggregate, for example of from 2.0 and up to 4.0% w/w of the combination of $Fe_2O_3$, $TiO_2$ and $Al_2O_3$.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

Example 1

Cores comprising a blend of silica sand and a zircon aggregate were prepared using a range of speciality zircon aggregates from different sources. The different zircon aggregates used to form the cores are listed in Table 1 below.

TABLE 1

| Speciality Aggregates evaluated | |
|---|---|
| 1 | Florida Zircon |
| 2 | South Africa Zircon |
| 3 | Iluka grade F Zircon |
| 4 | C80 Zircon |
| 5 | Iluka grade P Zircon |
| 6 | Carbo Accucast ID50-K |
| 7 | Spherichrome |
| 8 | Hevi Sand |

To prepare the cores, a Batch of silica sand (3000 grams) was placed in a Kitchen Aid mixer. A commercial Furan binder system was used for sand core preparation for all tests. A co-reactant was added to the sand and mixed for 60 seconds, after which the resin was added and mixed for a further 60 seconds. The sand was then packed into respective core boxes and allowed to cure while checking for work time and strip time. After strip time was reached, the cores were placed on a shelf and allowed to cure for 24 hours before testing. A resin content of 1% based on sand and co-reactant content of 30% based on resin was used for all cores.

Figure 1:
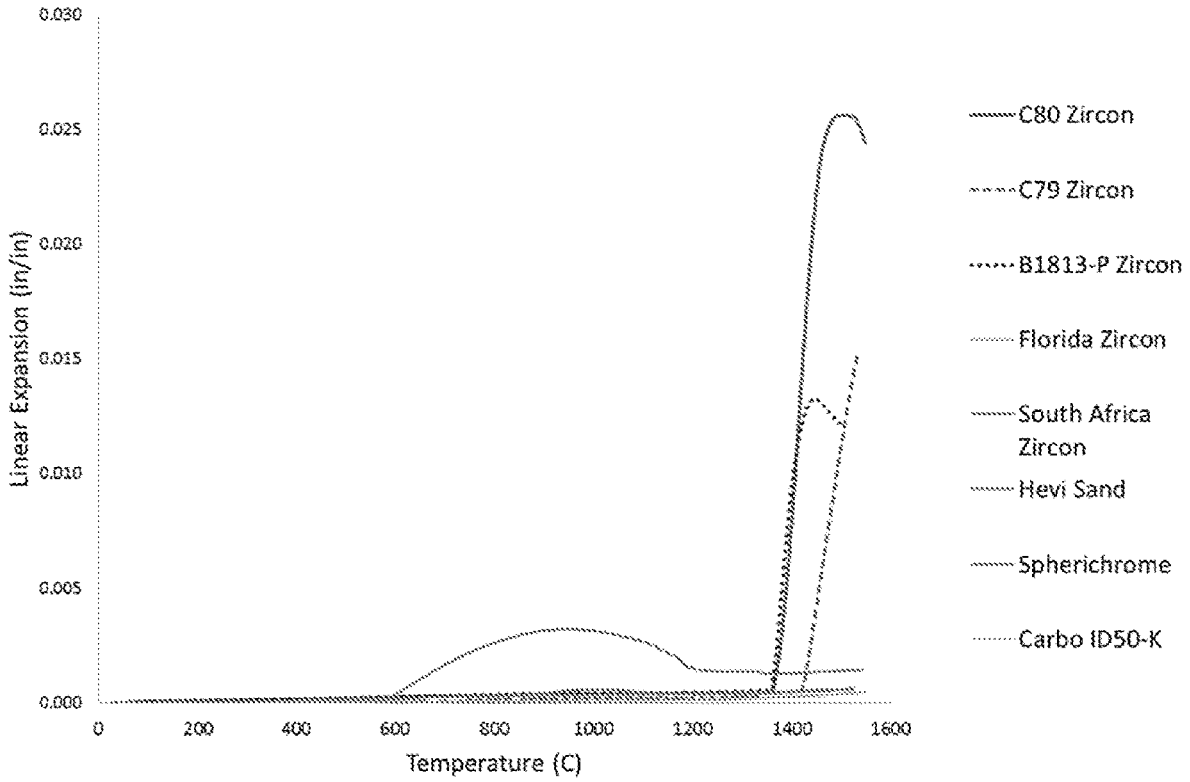
FIG. 1: Linear expansion curves for (a) C80 zircon, (b) Iluka grade F zircon, (c) Iluka grade P zircon, (d) Florida zircon, (e) South Africa zircon, (f) Hevi sand, (g) Spherichrome, and (h) Carbo ID50-K.

A dilatometer (The University of Northern Iowa) was used to run linear expansion tests. Tests were run from room temperature to a temperature of 1600° C. at a heating rate of 15° C. per minute. The thermal linear expansion curves obtained are shown in FIG. 1. With the exception of Iluka grade F, C80 and Iluka grade P Zircon, the linear expansion results of other aggregates were as expected. Low thermal linear expansion values were obtained for these aggregates.

Iluka grade F Zircon shows a sudden increase in expansion at 1400° C. while C80 and Iluka grade P zircon displays the same behavior at ~1340° C. The expansions seen for these three aggregates were unusual and, to verify the repeatability, these three samples were tested again. A good repeatability was obtained.

Surface Viscosity results were obtained from linear expansion using a constant load of 23.2 grams on the sample. Surface Viscosity is a measure of the movement of individual sand grains on the surface of the sample and is a good indicator of high temperature phase transitions and sinter points, especially in silica sand.

It was found that all aggregates displayed an initial increase in viscosity at around 100-150° C. This phenomenon is due to the resin in the aggregate providing an initial increase in the strength of the bonded aggregate. With the exception of Carbo ID50-K, the viscosity then decreased with temperature, leveling off at around 600-650° C., at which point the binder has been burnt off. After this, the viscosity is steady up to the high temperature range when sand sinters and the viscosity subsequently decreases.

Iluka grade F, C80 and Iluka grade P Zircon exhibited a sudden drop in viscosity at around 1400° C. Carbo ID50-K also had a rapid decrease in viscosity from 1100° C. to 1550° C. The surface viscosity of known aggregates typically decreases slowly with temperature.

Table 2 provides an analysis of the C80 zircon aggregate. The aggregate is a post-treated, highly separated and differentiated product from Iluka Resources Limited. A feature of this zircon aggregate is its relatively higher proportion of a combination of $Fe_2O_3$, $TiO_2$ and $Al_2O_3$. Most zircon aggregates contain no more than 2.0% w/w combination of $Fe_2O_3$, $TiO_2$ and $Al_2O_3$.

TABLE 2

Analysis of C80 Zircon aggregate

| Chemical Component | Composition (w/w %) |
|---|---|
| $ZrO_2$ and $HfO_2$ | 64.0-66.7 |
| $Fe_2O_3$, $TiO_2$ and $Al_2O_3$ | 1.0-4.0, usually 2.0-4.0 |
| $SiO_2$, CaO and $P_2O_5$ | 32.0-34.5 |
| Free Silica | 0.01-0.1 |

Example 2

A series of tests was conducted to evaluate the effect of blending a selected zircon aggregate with silica sand in various proportions. The selected zircon aggregate was C80 zircon from Example 1. Tests were conducted to evaluate the high temperature physical properties of the blends. Test step-cone castings were poured to analyse for defects. These castings were measured to evaluate dimensional accuracy and the results were plotted out. Veining and penetration defects were analysed and ranked according to a method developed at the University of Northern Iowa.

Samples were made from baseline silica sand and silica sand containing C80 zircon blends. All samples were tested for thermal linear expansion and viscosity, specific heat capacity and casting quality. The various sand blend samples that were tested are shown in Table 3.

TABLE 3

Sand Samples Tested

| | |
|---|---|
| C80-1 | Baseline Silica |
| C80-2 | Silica with 10% Zircon |
| C80-3 | Silica with 20% Zircon |
| C80-4 | Silica with 30% Zircon |
| C80-5 | Silica with 40% Zircon |

Core Preparation

Expansion and Step-cone cores were prepared using the Phenolic Urethane Cold-Box binder system. The sand blend samples were split using a 16 way sand splitter to obtain a representative grain distribution. Split silica sand was placed in a Kitchen Aid mixer. The C80 zircon aggregate was then added to the mixer and the blend mixed for 30 seconds. The Part I resin was then added and mixed for a minute. The mixing bowl was then removed and the sand was flipped to ensure even coating. The Part II resin was then added and the same procedure was repeated. The final mixture was then placed in the respective core boxes and was gassed in a Redford Cold-Box gassing chamber. A gassing pressure and purging pressure of 20 psi (137.8 Pa) and 40 psi (275.6 Pa) were respectively used.

Expansion cores were gassed for 0.5 minutes and purged for 7 seconds while step-cone cores were gassed for 5 seconds and purged for 30 seconds. The resulting cores were allowed to sit for 24 hours before further testing.

Tests

Thermal linear expansion tests were run using the University of Iowa's high temperature aggregate dilatometer. The dilatometer has a single push rod design and can be run under controlled atmosphere. This unit is capable of reaching a maximum temperature of 1650° C. Expansion cores made were cylindrical in shape with a height of 3.81-4.06 cm and a diameter of 2.8 cm. The samples were heated to 1650° C. at a heating rate of 15° C. per minute in a ceramic sample holder and the resulting deformation was recorded. All tests were run in a neutral atmosphere.

Surface viscosity was calculated from the deformation recorded from the dilatometer and is useful to describe the sintering characteristics of an aggregate. The method to calculate surface viscosity was first presented by Gabriel Tardos et al. from the department of Chemical Engineering, City College of New York (G. Tardos, D. Mazzone, R. Pfeffer, Measurement of Surface Viscosities using a dilatometer, The Canadian Journal of Chemical Engineering, Vol. 62, P 884-888). Sand grains will initially expand with temperature but will contract subsequently at high temperatures due to softening and sintering on the surface under load at inter granular contact points. The soft sand particles can be assumed to behave as a Newtonian fluid, based upon which a surface viscosity can be defined. Surface viscosity was calculated at sintering temperature for each sand sample.

Experimental Step-Cone Castings

Figure 3:
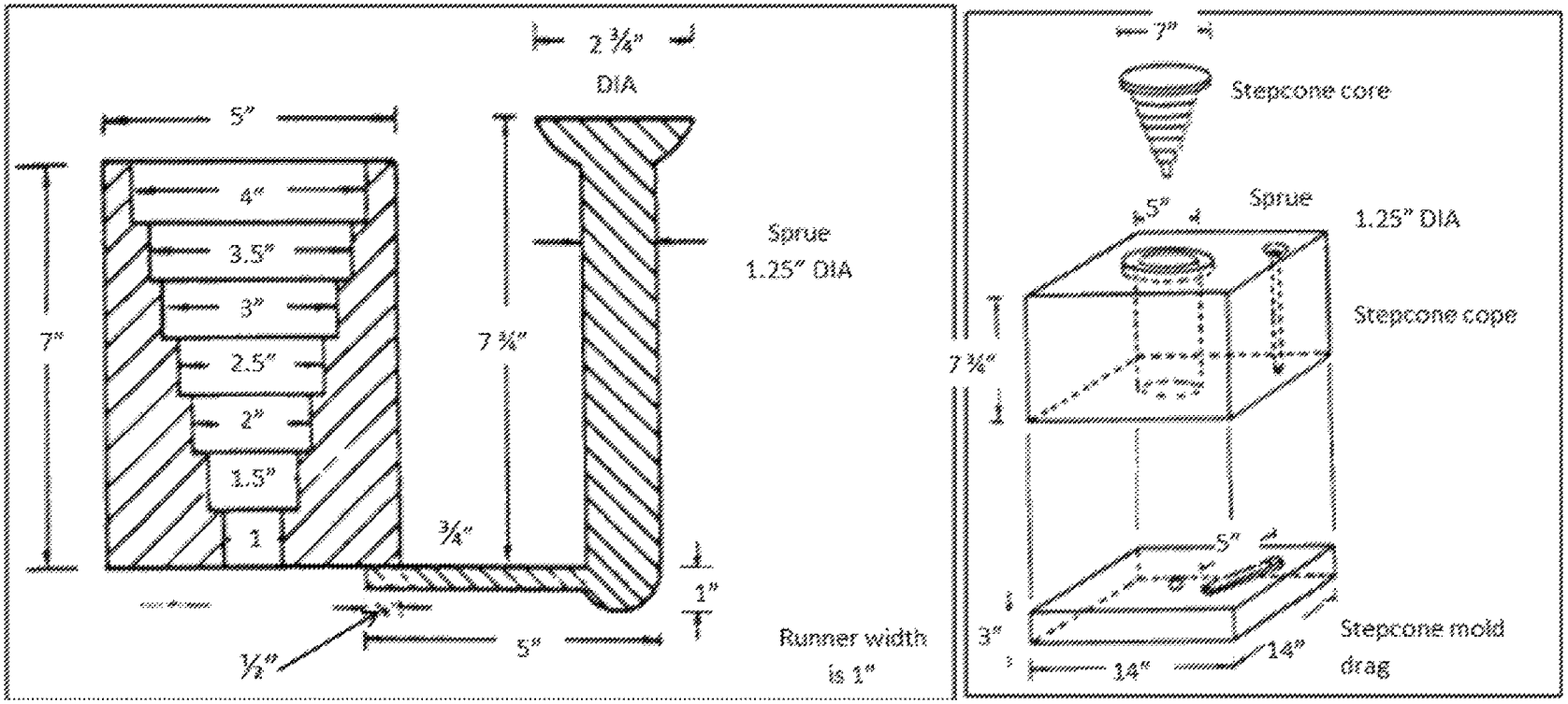
FIG. 3: Schematic of step-cone casting apparatus.

This test was conducted by pouring metal against a step cone core. The step cone core consists of 6 different sections with steps from 1.5 inches (3.81 cm) to 4 inches (10.16 cm) in 0.5 inch (1.27 cm) increments. A general schematic for forming the castings is shown in FIG. 3. The different steps are representative of different section thicknesses of the metal casting and hence give a good understanding of the role of different cooling rates of the metal in casting quality and defects. The mould is produced flaskless using a similar binder system, but does not affect the veining, penetration or dimensional accuracy tendencies of the test casting. The test castings were poured from a variety of metals including grey iron, steel and copper based alloys. Pouring times for the moulds are approximately 10-12 seconds. Once the castings had cooled to room temperature, they were removed and the gates sectioned off along with loose sand. The castings were wire brushed and sand blasted to remove any loose sand on the surface and were then tested for dimensional accuracy. Following this, they were sectioned and evaluated for veining and penetration defects.

Melting Procedure

The composition of the metal used in the trials was consistent with the chemistry used to produce standard class low alloy steel. The metal was melted in a 340 lb. high frequency coreless induction furnace utilizing a neutral refractory lining. After meltdown, the slag was removed, a thermal analysis sample was taken, and the temperature of the molten metal was raised to approximately 1676° C. The heats were tapped into a preheated 350 lb. heated monolithic ladle. The metal was then poured into the moulds located on the pouring line using a target pouring temperature of 1600° C. An approximate total target pour time of 10 to 12 seconds was used.

Results

Figure 2:
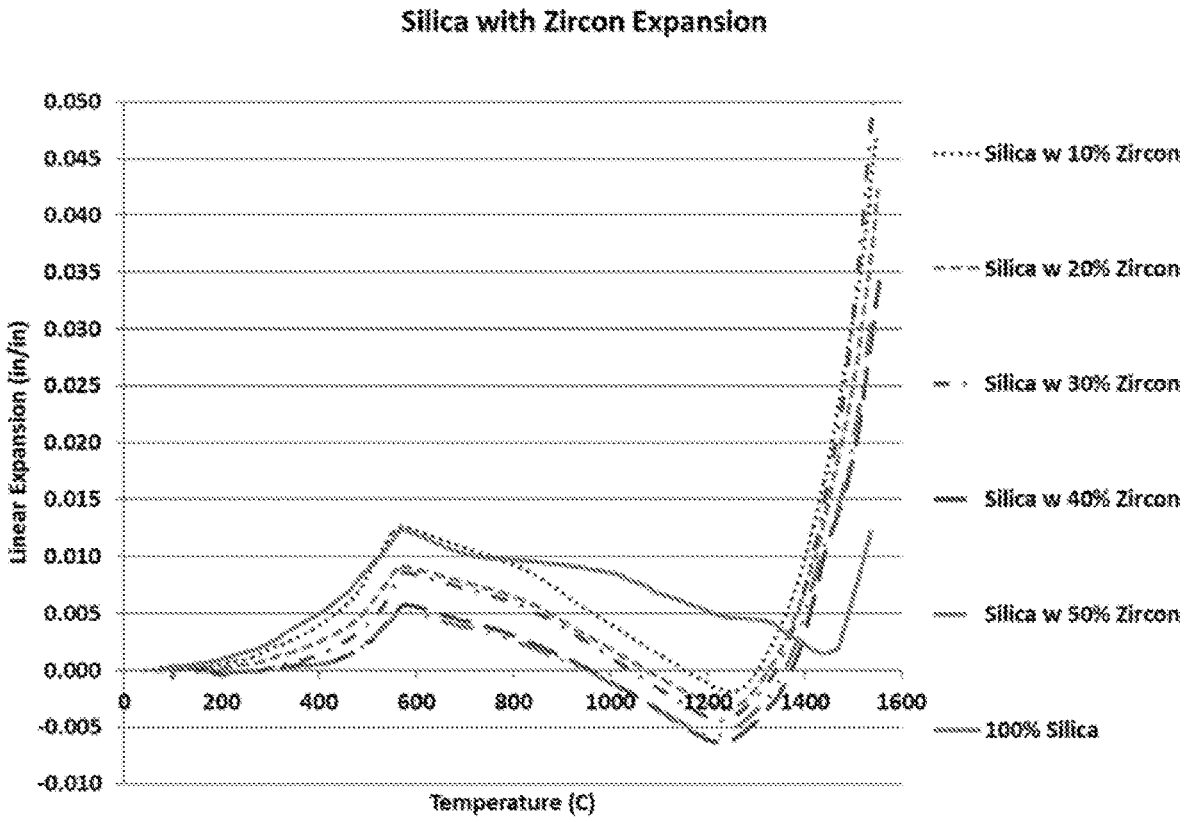
FIG. 2: Graph of linear expansion vs. temperature for (a) silica blended with 10 wt % zircon, (b) silica blended with 20 wt % zircon, (c) silica blended with 30 wt % zircon, (d) silica blended with 40 wt % zircon, and (e) silica.

The expansion results determined for baseline silica are shown in FIG. 2. It can be seen that silica sand undergoes an alpha-beta phase transition at approximately 570° C. (1058° F.). This leads to a large peak expansion at the same temperature. A peak expansion of 0.0115 in/in (cm/cm) was recorded. After the alpha-beta phase transition, a steady contraction of the sand can be seen till the cristobalite phase transition at 1470° C. where the beginning of a secondary expansion can be seen. This steady contraction exerts a strain on the surface of the core as the surface layers of a core contract while the sub layers are still expanding to the alpha-beta transition. This leads to the formation of cracks, thus leading to veining defects. The high peak expansion seen at the alpha-beta transition leads to dimensional inaccuracy of castings.

FIG. 2 also shows the expansion results for the silica with zircon blend samples. The peak expansion for silica with 10% zircon is similar to baseline silica sand. However, from 20% zircon onwards, a reduction in the alpha-beta phase transition peak expansion can be seen with silica with 40% zircon having the lowest peak of 0.005 in/in (cm/cm), which is lower than baseline silica by 56%.

Another trend that can be seen in the silica with zircon samples is that the cristobalite phase transition is induced at a lower temperature. A steep contraction can be seen from the alpha-beta phase transition to the cristobalite phase transition. However, since the cristobalite phase transition is occurring at approximately 1200° C. (2192 F), the large secondary expansion occurs at a lower temperature, thereby negating the strain on the surface of the core at the high temperatures seen in steel castings.

This provides a secondary increase in strength on the surface of the core, preventing cracks from forming on the surface and, hence, reducing veining defects.

The sintering temperature and the peak viscosity at sintering temperature for each sample are shown in Table 4, along with the associated specific heat capacity at 1200° C. Baseline silica has a sinter temperature of 1437.4° C. (2619.3 F) with a peak viscosity of $5.030\times10^{8}$ Pa·s ($5.03\times10^{11}$ cP). It can be seen that the sinter temperature of the zircon blends decreases with increasing amounts of the zircon aggregate. However, with the zircon blends, the peak viscosity increases with increasing amounts. This indicates that the core integrity at high temperatures will be higher for increasing amounts of zircon thereby leading to lower dimensional inaccuracy.

TABLE 4

Sinter Temperature and Peak Viscosity Data

| Sample ID | Sinter Temperature degrees C. | Peak Viscosity (Pa · s) | Specific heat capacity at 1200 C (J/g · C.) |
|---|---|---|---|
| Baseline silica | 1437.4 | 5.030 × 10^8 | 1.2 |
| Silica with 10% zircon | 1252.7 | 9.282 × 10^8 | 1.1 |
| Silica with 20% zircon | 1238.6 | 8.819 × 10^8 | 1.09 |
| Silica with 30% zircon | 1234.3 | 1.122 × 10^9 | 1.07 |
| Silica with 40% zircon | 1231.1 | 1.724 × 10^9 | 1.07 |

Casting Quality Analysis

Figure 4:
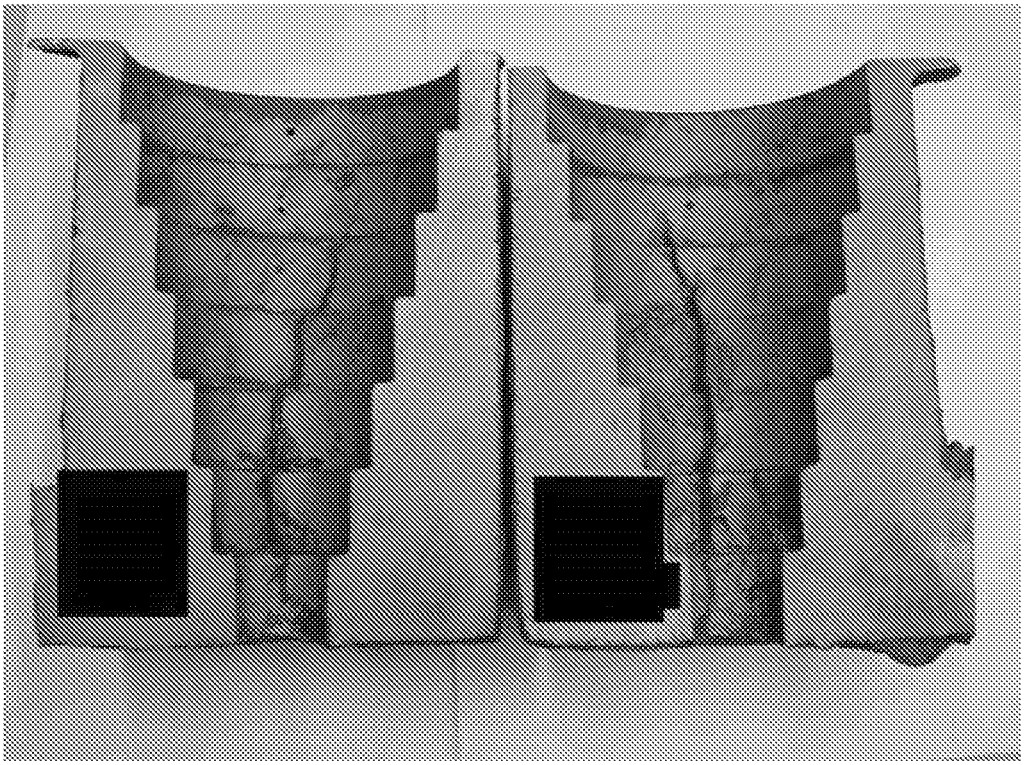
FIG. 4: Photograph of indicative steel step-cone casting obtained using a core formed from silica sand.

The baseline silica casting obtained is shown in FIG. 4. It can be seen that the casting exhibits several veins along the surface, which is typical of silica sand castings. No penetration defects are visible. More veins are formed along the thicker sections of the casting, where the metal takes longer to solidify. This would enable the cores to reach higher temperatures while the metal is still in its liquid form.

Figure 5:
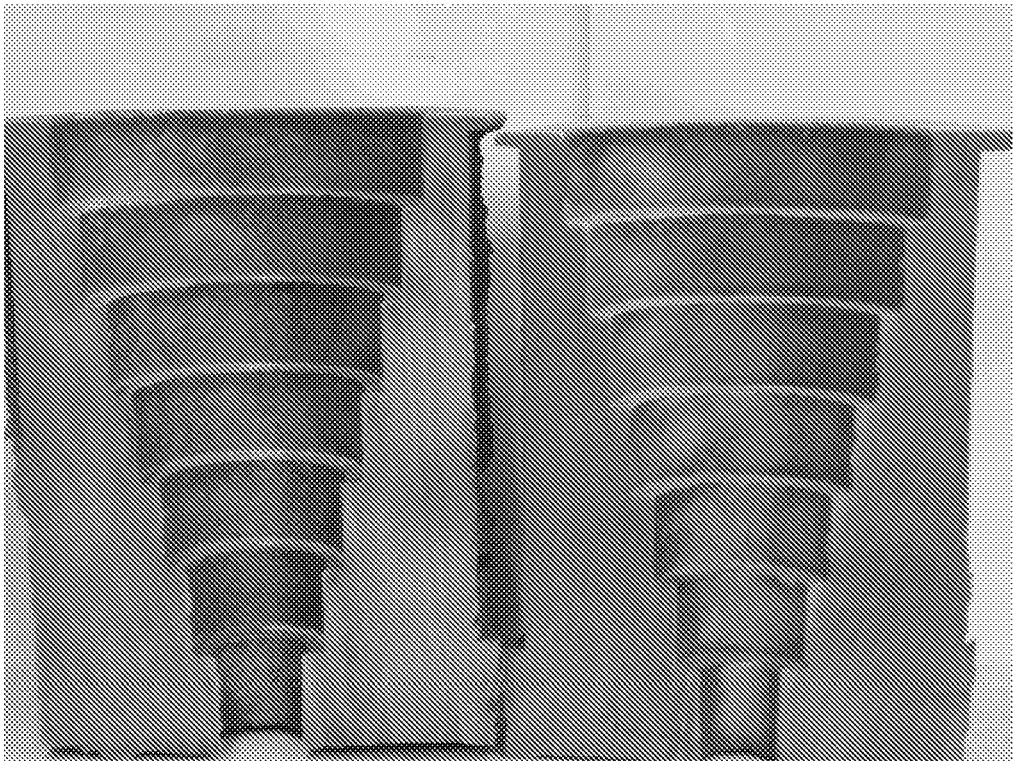
FIG. 5: Photograph of indicative steel step-cone casting obtained using a core formed from silica sand blended with 10 wt % C80 zircon aggregate.
Figure 6:
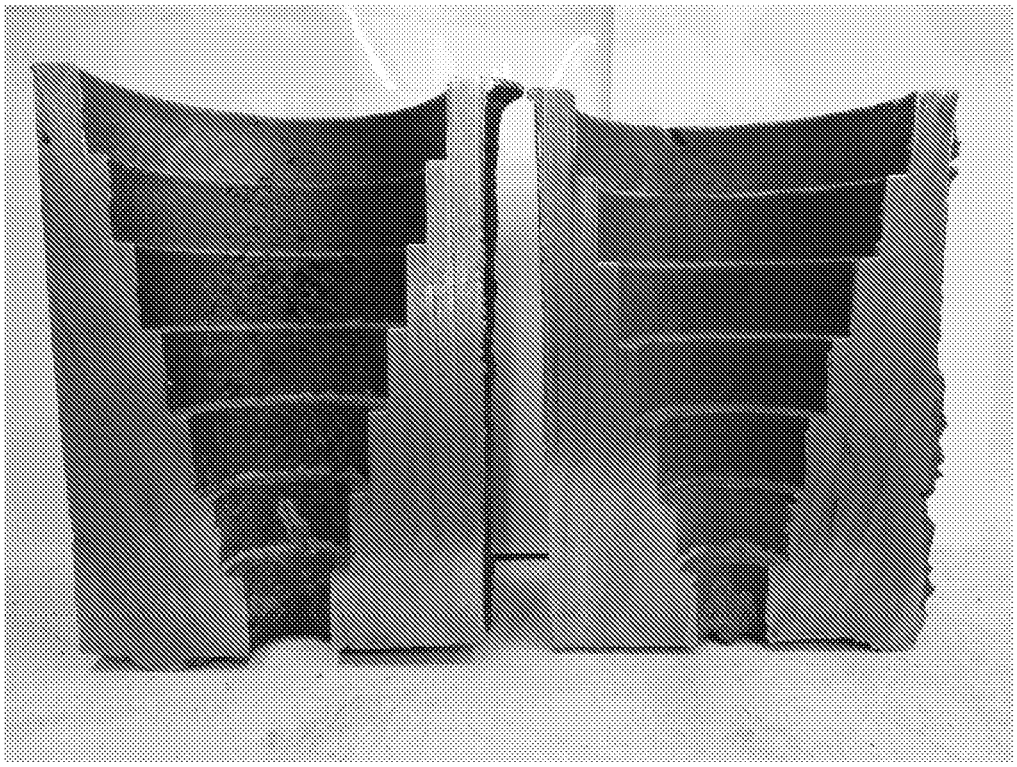
FIG. 6: Photograph of indicative steel step-cone casting obtained using a core formed from silica sand blended with 20 wt % C80 zircon aggregate.
Figure 7:
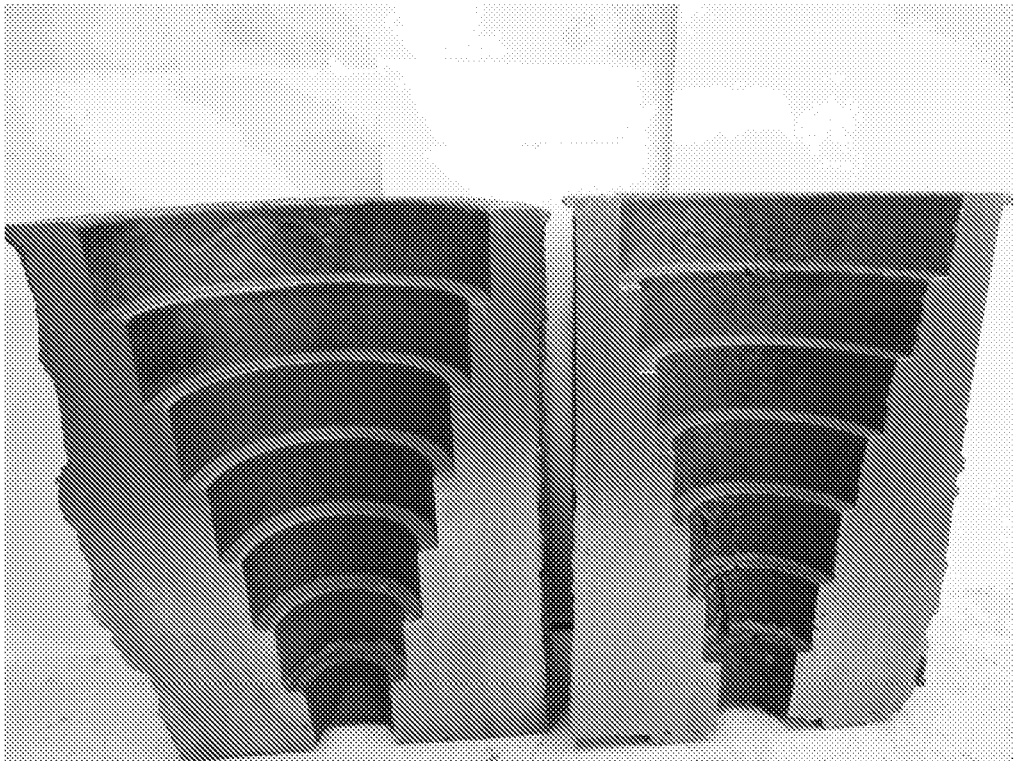
FIG. 7: Photograph of indicative steel step-cone casting obtained using a core formed from silica sand blended with 30 wt % C80 zircon aggregate.
Figure 8:
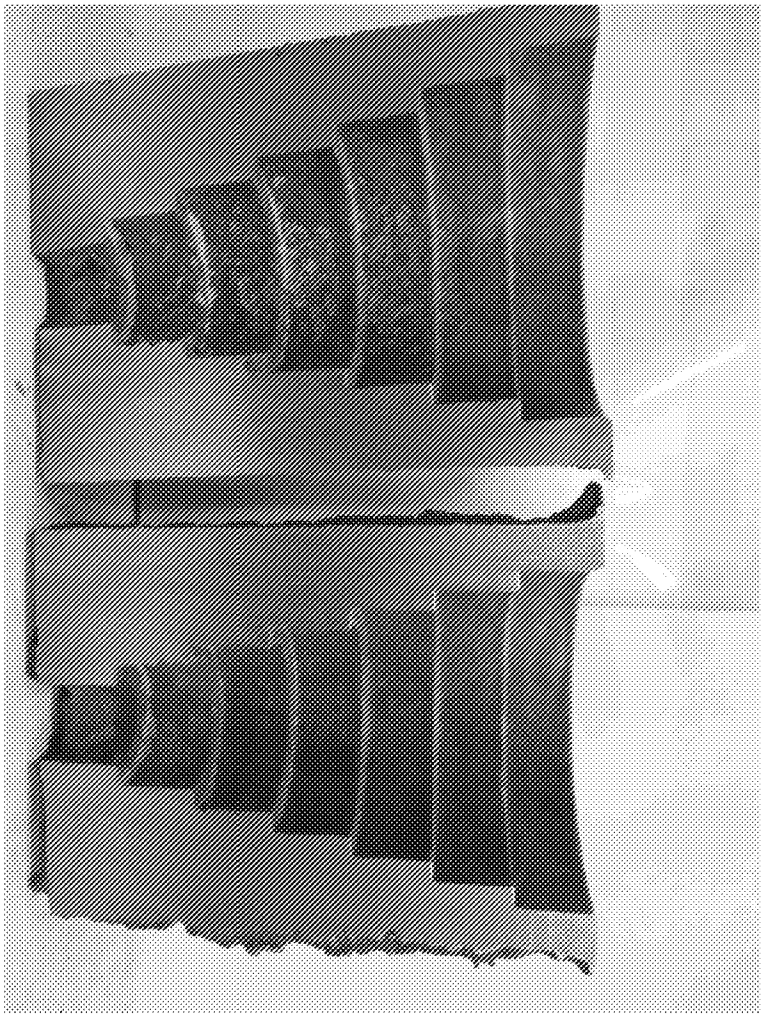
FIG. 8: Photograph of indicative steel step-cone casting obtained using a core formed from silica sand blended with 40 wt % C80 zircon aggregate.

Silica with 10% zircon (see FIG. 5) does not display any veining or penetration defects. Though the alpha-beta transition peak expansion for silica with 10% zircon is similar to baseline silica, the early inducement of the cristobalite transition, the secondary expansion and higher viscosity at sintering temperature leads to lower strain on the surface of the core, thereby reducing the veining defect. However, silica with 20%, 30% and 40% zircon display slight veining and penetration defects at the thicker casting sections as seen in FIGS. 6, 7 and 8.

Table 5 displays the veining and penetration ranking for baseline silica and the various blends. It can be seen that a lower content of the specialty aggregates display better performance when compared to the higher content. Baseline silica has a high veining index, as expected. Silica with 10% zircon displays no indications of veining or penetration defects.

TABLE 5

Penetration and Veining Ranking

| Sample ID | Penetration Index | Veining Index |
|---|---|---|
| Baseline Silica | 0 | 43 |
| Silica w 10% Zircon | 0 | 0 |
| Silica w 20% Zircon | 11 | 9 |
| Silica w 30% Zircon | 6 | 9 |
| Silica w 40% Zircon | 11 | 5 |

It has been shown that as little as 10% of the selected zircon aggregate can improve the quality of the final casting by reducing the extent of veining and penetration defects and creating a more linear dimensional relationship between the mold cavity and the final casting dimensions. It should be noted in general that the effect of blending silica sand and specialty sands is highly dependent on the thermal input of the metal and the mass of the mold that determines the heating rate of the mold and associated cooling rate of the casting. The chemical reaction between the base sand and the speciality sand must be accurately determined, as was the case with silica sand blends. Higher heat inputs in the larger metal sections caused the mixture to fuse causing casting defects.

Example 3

A further series of tests were conducted to evaluate the effect of blending another zircon aggregate with silica sands in various proportions to determine whether high quality castings could be produced using an uncoated core (i.e. a core that is not coated with a refractory material on the surfaces that contact molten metal during the casting process). The selected zircon aggregate was E2 zircon. The composition of the E2 blend is provided in Table 6 below:

TABLE 6

Analysis of E2 Zircon aggregate

| Chemical Component | Composition (w/w %) and property |
|---|---|
| $ZrO_2$ and $HfO_2$ | 64.0-66.7 |
| $Fe_2O_3$, $TiO_2$ and $Al_2O_3$ | 0.7-4.0, usually 0.8-4.0 |
| $SiO_2$, CaO and $P_2O_5$ | 32.0-34.5 |
| Free Silica | 0.01-0.4 |
| Thermal expansion profile (crystalline property) | Expands at greater than 1,200 degrees C. |

As with the C80 aggregate characterised in Table 2, a feature of the E2 zircon aggregate is its relatively higher proportion of a combination of $Fe_2O_3$, $TiO_2$ and $Al_2O_3$. Most zircon aggregates contain no more than 2.0% w/w combination of $Fe_2O_3$, $TiO_2$ and $Al_2O_3$.

Tests were conducted to evaluate the high temperature physical properties of the E2 zircon bonded with a furan binder system at 1.0 wt % resin content.

Figure 16:
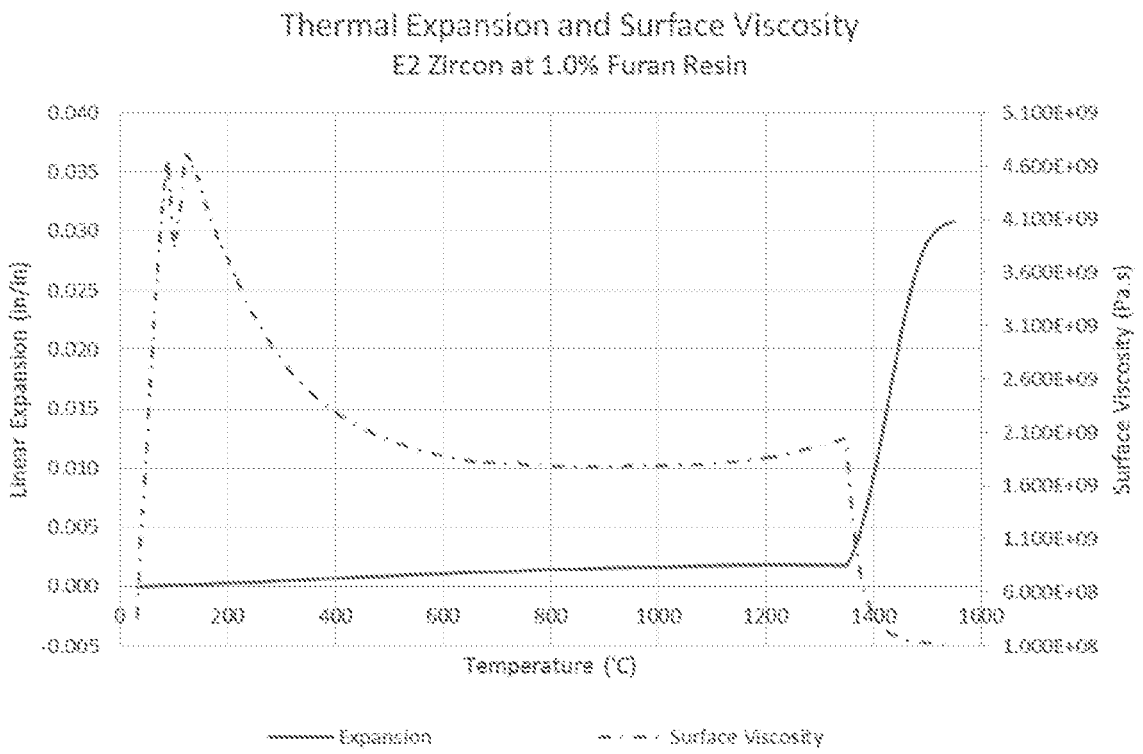
FIG. 16: Graph showing the thermal expansion and surface viscosity of an E2 zircon bonded with a furan binder system at 1.0 wt % resin content

FIG. 16 is a graph showing the thermal expansion and surface viscosity of an E2 zircon bonded with a furan binder system at 1.0 wt % resin content. The sample was observed to have a steady state expansion from room temperature to about 1350° C. At 1350° C., the expansion was measured to be 0.00176 in/in. After this point, a rapid increase in expansion can be observed in the sample. At the end of the test, at about 1600° C., the expansion was measured to be 0.03 in/in.

Surface viscosity was measured from the linear expansion results. The surface viscosity is a measure of the movement of individual sand grains on the surface of the sample and is a good indicator of high temperature phase transitions and sinter points. An initial increase in viscosity can be seen from room temperature to about 120° C. After this point, the viscosity can be observed to decrease steadily up to a temperature of about 1100° C. A slight increase in viscosity can be observed from 1100° C. leading to the sinter temperature of the material. The sinter temperature was measured to be about 1350° C., after which, a rapid decrease in viscosity was observed.

Figure 17:
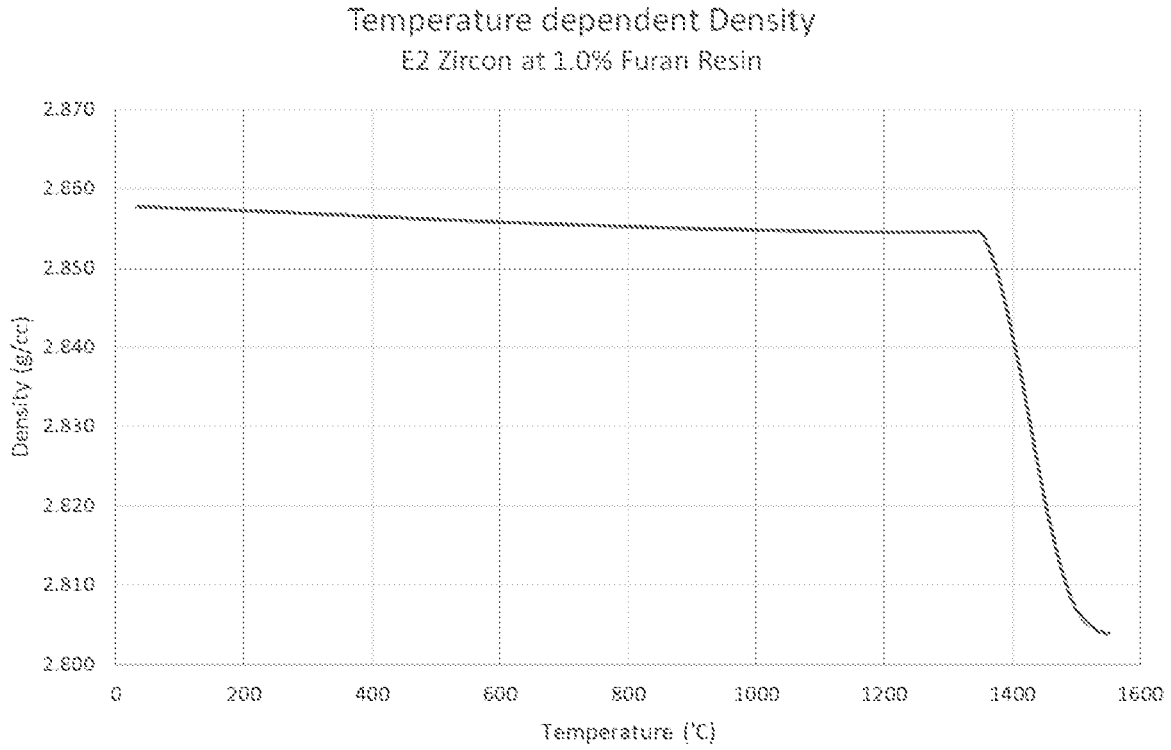
FIG. 17: Graph showing the temperature dependent density calculated using the linear expansion values derived from FIG. 16.

FIG. 17 is a graph showing the temperature dependent density calculated using the linear expansion values derived from FIG. 16. The calculated density represents the bulk density of the sample. The density can be seen to decrease steadily from 178.4 lbs./ft$^3$ (2857.7 kg/m$^3$) at room temperature to 178.2 lbs./ft$^3$ (2854.5 kg/m$^3$) at the sinter temperature. A sharp decrease in density can be observed after this point. At the end of the test, the density of the aggregate was measured to be 175.04 lbs./ft$^3$ (2803.9 kg/m$^3$).

Figure 18:
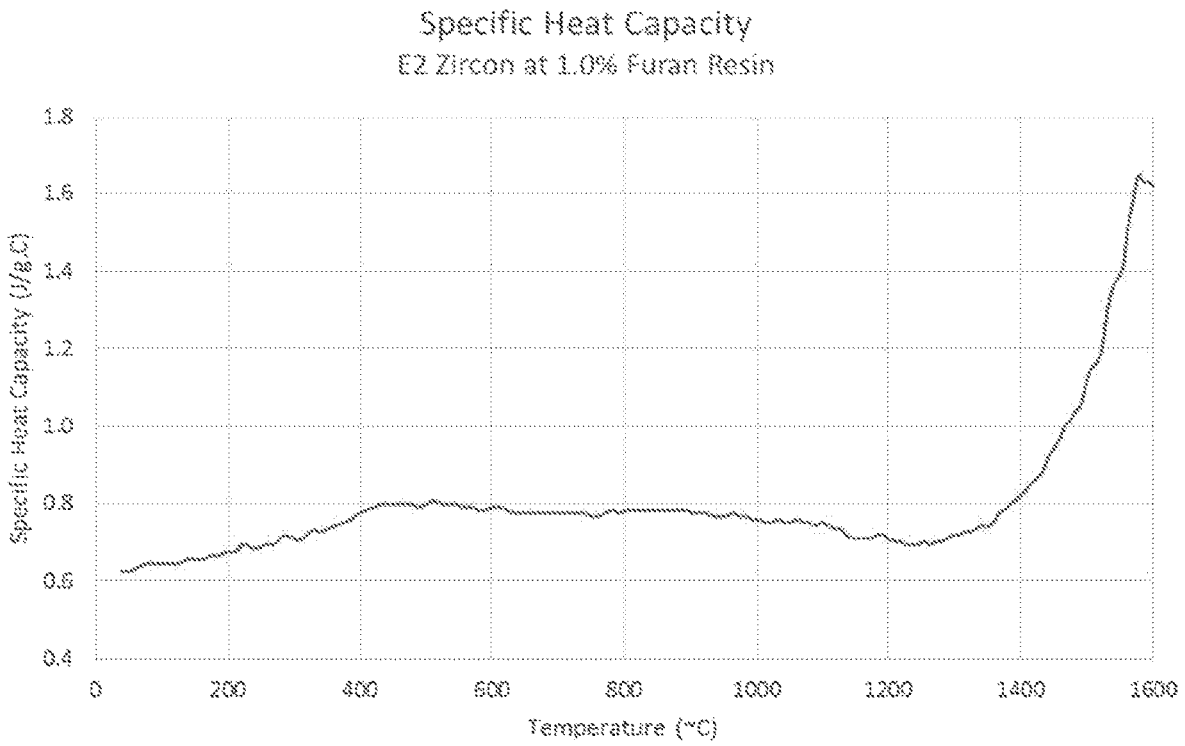
FIG. 18: Graph showing specific heat capacity results of an E2 zircon bonded with a furan binder system at 1.0 wt % resin content.

FIG. 18 shows the specific heat capacity ($C_P$) results of an E2 zircon bonded with a furan binder system at 1.0 wt % resin content. From the results it can be seen that the specific heat capacity of the material increases steadily from room temperature to 400° C. after which, it remains steady at about 0.8 J/g.° C. till a temperature of approximately 1335° C. After this point, a rapid increase in $C_P$ can be observed leading to the end point of the test at about 1600° C.

In view of the above, the E2 zircon is shown to exhibit a sharp rise in linear thermal expansion coefficient similar to that exhibited by the C80 zircon. As discussed above, it is thought that this property is related to the relatively higher proportion of a combination of $Fe_2O_3$, $TiO_2$ and $Al_2O_3$. To explore this further, mineralogy testing was conducted to determine the mineral phases present in different zircon aggregates. Table 7 below shows modal abundance data for phases present in the zircon concentrates. The modal abundance data represents mineralogy inferred on the basis of chemistry.

TABLE 7

Modal abundance data (in area %) for phases present in zircon concentrates

| Phase | E2 Zircon | C80 Zircon | Florida Zircon | South Africa Zircon |
|---|---|---|---|---|
| Zircon | 97.8 | 93.1 | 97.3 | 98.5 |
| Chromite | 1 | 0.52 | | |
| Barite | 0.23 | 0.017 | | |
| Kaolinite | 0.18 | 0.12 | 0.023 | 0.009 |
| Quartz | 0.16 | 0.63 | 0.045 | 0.095 |
| Kyanite | 0.15 | 4.6 | 1.7 | |
| Rutile | 0.12 | | 0.42 | 0.17 |
| Epidote | 0.1 | | | |
| Mica | 0.1 | | | |
| Apatite | 0.053 | 0.029 | 0.033 | 0.38 |
| Feldspar | 0.034 | 0.03 | | 0.082 |
| Xenotime | 0.026 | 0.058 | | |
| Monazite-Ce | 0.025 | 0.011 | 0.068 | |
| Fe Oxide (Si, Al) | 0.01 | | | |
| Fe Sulphide | 0.0005 | 0.012 | | |
| K Al Sulphate | 0.0002 | 0.003 | | |
| Ilmenite | | 0.32 | | |
| Pyroxene | | 0.073 | | 0.1 |
| Zr Silicate (Ca, Al, Y, Sc) | | 0.26 | | 0.004 |
| Fe Aluminosilicate | | 0.091 | | 0.013 |
| Corundum | | 0.14 | 0.2 | 0.018 |
| Sr Crandallite | | 0.009 | | |
| Epidote | | 0.023 | | |
| Topaz | | | | |

Without wishing to be bound by theory, the inventors are of the view that the higher than usual quantities of kyanite, barite, and/or chromite likely contribute to the sharp rise in linear thermal expansion coefficient. By way of example, the inventors believe a modal abundance of kyanite in the zircon aggregate of 0.1 area % or greater; preferably 2% or greater; more preferably 3% or greater; and most preferably 4 area % or greater contributes to this phenomenon. Alternatively, or additionally, a modal abundance of barite in the zircon aggregate of 0.01 area % or greater; preferably 0.05 area % or greater; more preferably, 0.1 area % or greater; and most preferably 0.15 area % or greater contributes to this phenomenon. Alternatively, or additionally, the modal abundance of chromite in the zircon aggregate is 0.2 area % or greater; preferably 0.3 area % or greater; more preferably 0.4 area % or greater; most preferably 0.5 area % or greater.

In one or more forms, it is preferred that the modal abundance of kyanite in the zircon aggregate is 6 area % or less; preferably 5% or less. Alternatively, or additionally, the modal abundance of barite in the zircon aggregate is 0.4 area % or less; preferably 0.3% or less. Alternatively, or additionally, the modal abundance of chromite in the zircon aggregate is 1.5 area % or less; preferably 1.25 or less.

Example 4

A series of tests was conducted to evaluate the effect of blending the E2 zircon aggregate with silica sand in various proportions. Tests were conducted to evaluate the high temperature physical properties of the blends. Test step-cone castings were poured to analyse for defects. These castings were measured to evaluate dimensional accuracy and the results were plotted out. Veining and penetration defects were analysed and ranked according to a method developed at the University of Northern Iowa. The various samples of silica sand and E2 zircon are outlined in Table 8 below:

TABLE 8

| Sand Samples Tested | |
|---|---|
| E2-1 | Baseline Silica |
| E2-2 | Silica with 7.5 wt % Zircon |
| E2-3 | Silica with 10 wt % Zircon |
| E2-4 | Silica with 15 wt % Zircon |

Each of the blends was then used to prepare a step-cone core. A commercial Phenolic Urethane binder system was used for sand core preparation for all tests. A resin content of 1.25% based on sand with a Part I:Part II ratio of 55:45 was used. Step-cone moulds were produced using the continuous No-Bake mixer which uses the Bio-Urethane binder system. The step-cone cores were not coated with a refractory coating in order to evaluate the effectiveness of zircon addition on eliminating the use of refractory coatings to improve the surface quality of grey iron castings.

Class 30 grey iron castings were poured. The finished castings were sectioned and sand blasted to evaluate for penetration defects using the ranking system developed at the University of Northern Iowa.

Testing Methodology

Preparation of Cores

Expansion, tensile and step-cone cores were produced using a Phenolic Urethane No-Bake binder system. A KitchenAid mixer was used to prepare cores. Batch weights of 3500 grams were used.

E2 zircon aggregate was added to silica sand in mixing bowl at the required ratio. The silica-zircon blend was then mixed for one minute. The Part I resin was then added to the sand and mixed for 60 seconds after which the Part II resin was added and mixed for 60 seconds. Finally, a liquid amine catalyst was added and mixed for 60 seconds. The sand was then packed in the respective core box and allowed to cure, while work time and strip time was recorded. After strip time was reached, the cores were placed in a desiccator. A resin content of 1.25% was used with a Part I:Part II ratio of 55:45 and catalyst content of 3% based on Part I.

The step-cone cores were cured for 24 hours before pouring. All the step-cone cores were poured uncoated. Although core coatings are typically used for iron castings to improve surface quality, this experiment was for the purpose of evaluating the effectiveness of the zircon aggregate as an additive to improve surface quality in the absence of a core coating.

Physical Properties

The physical properties tested included tensile strength, thermal expansion and surface viscosity. A Thwing-Albert tensile tester was used to measure tensile strengths of the tensile specimen. Thermal expansion tests were run on bonded sand samples utilizing a high temperature aggregate dilatometer. The expansion cores had a height of approximately 1.6 inches (4.06 cm) and a diameter of 1.1 inches (2.8 cm). The samples were heated to 1650° C. (3002° F.) at a heating rate of 15° C. per minute and the resulting deformation was recorded. Surface viscosity was calculated from the deformation recorded from the dilatometer and was used to determine the sinter temperature of the bonded samples.

Moulding and Melting Procedure

Step-cone moulds were prepared using the continuous No-Bake mixer. A Bio-Urethane binder system was used for the moulds. A schematic for forming the castings is shown in FIG. 2.

The composition of the metal used in the trials was consistent with the chemistry used to produce a standard class low alloy steel and class 30 grey iron. The metal was melted in a 340 lb. high frequency induction furnace utilizing a neutral refractory lining and was tapped into a 350 lb. heated monolithic ladle. A target pouring temperature of 2650° F. (1454° C.) and pouring time of 10-12 seconds per mould was used.

Results

Tensile Strength Results

Figure 9:
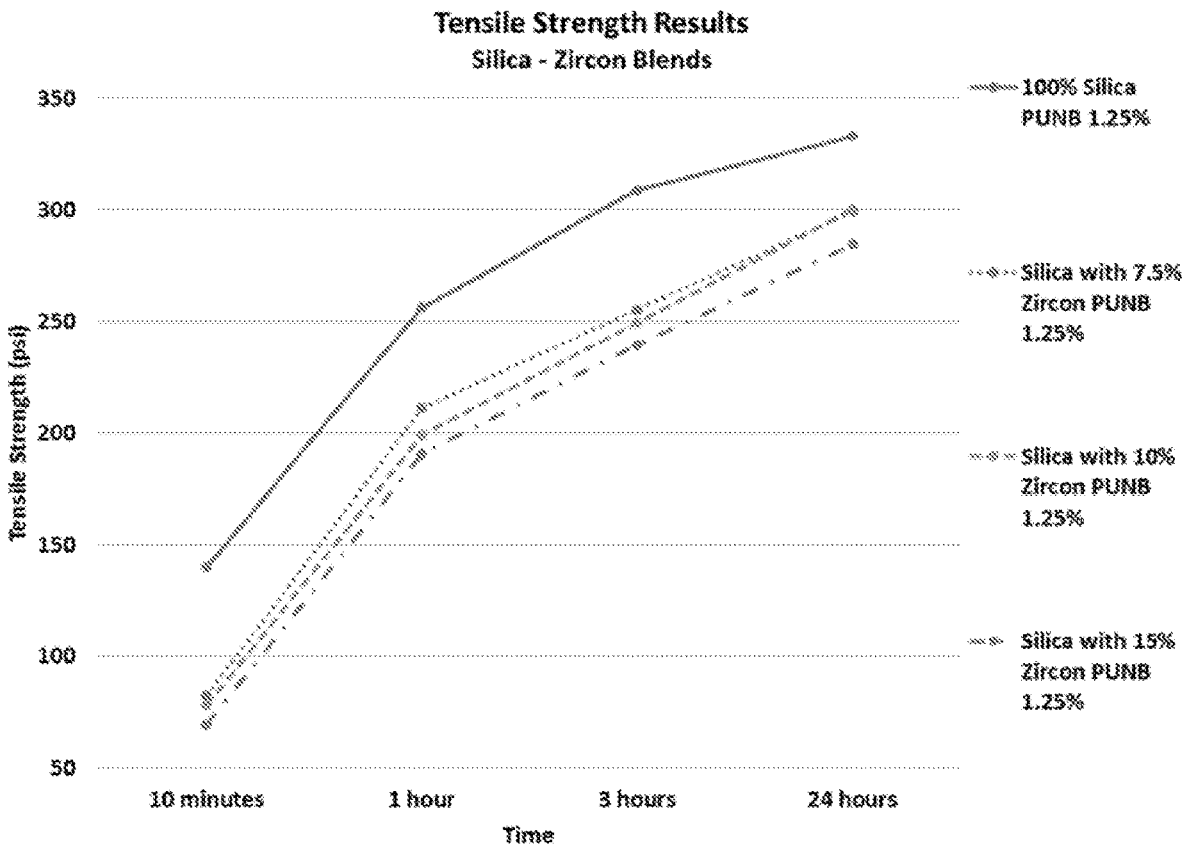
FIG. 9: Graph of tensile strength for (a) silica with 1.25 wt % polyurethane binder, (b) silica blended with 7.5 wt % zircon and 1.25 wt % polyurethane binder, (c) silica blended with 10 wt % zircon and 1.25 wt % polyurethane binder, (d) silica blended with 15 wt % zircon and 1.25 wt % polyurethane binder.

The tensile strength results for the four samples are shown in FIG. 9. The baseline silica sample is observed to have tensile strength of over 300 psi at 3 hours and 24 hours. At 24 hours, a tensile strength of 333.1 psi was measured. In comparison, the three blends were observed to have slightly lower tensile strengths. However, all three samples were measured to have considerably higher strengths of ~250 psi at 3 hours and ~280-290 psi at 24 hours. The three zircon blend samples were observed to have similar tensile strength profiles.

In view of the above, the addition of zircon to silica sand does not have a significant adverse effect on the tensile strengths of bonded cores. The tensile strengths of the silica-zircon blends, though lower than the baseline silica sample, were considerably high.

Thermal Expansion and Surface Viscosity Results

Figure 10:
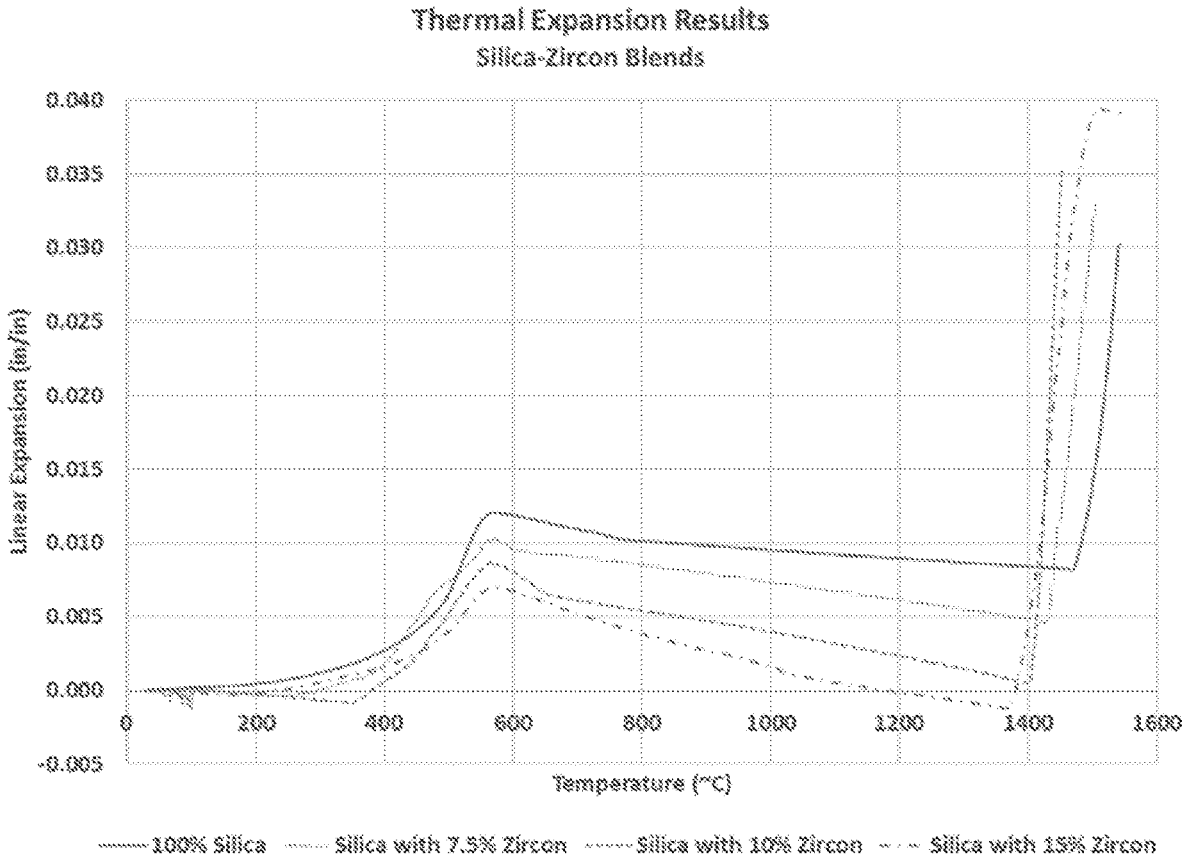
FIG. 10: Graph of linear expansion vs. temperature for (a) silica, (b) silica blended with 7.5 wt % zircon, (c) silica blended with 10 wt % zircon, (d) silica blended with 15 wt % zircon.

The expansion results for the four samples are shown in FIG. 10. All samples were observed to expand rapidly leading to the alpha-beta phase transformation of silica sand at 573° C. (1063° F.). However, it can be observed that the peak expansion at the alpha-beta transformation reduces with increasing zircon content in silica sand. The baseline silica sand sample was measured to have a peak expansion of 0.012 in/in while the 15% zircon blend sample had a peak expansion of 0.00696 in/in at this temperature.

After the alpha-beta phase transformation, all samples were observed to contract leading to the cristobalite phase transformation at higher temperature, at which point, a large secondary expansion is observed in all samples. As can be seen, the cristobalite phase transformation is induced at a lower temperature for the sand samples containing zircon in comparison to the baseline silica sand sample. The cristobalite phase transformation for the baseline silica sand sample commences at approximately 1470° C. (2678° F.). This temperature reduced with increasing zircon content in the samples. The 7.5%, 10% and 15% zircon samples were observed to start the cristobalite transformation at 1429° C. (2604° F.), 1401° C. (2554° F.) and 1371° C. (2500° F.) respectively.

Surface viscosity was measured from the linear expansion results. This is a measure of the movement of individual sand grains on the surface of the sample and is a good indicator of high temperature phase transitions and sinter points. All samples were observed to have high viscosity initially. The viscosity of the samples decrease rapidly leading to the alpha-beta phase transformation of silica sand at 573° C. (1063° F.). After this point, a steady increase in viscosity can be observed in all samples leading to the sinter temperature.

Figure 11:
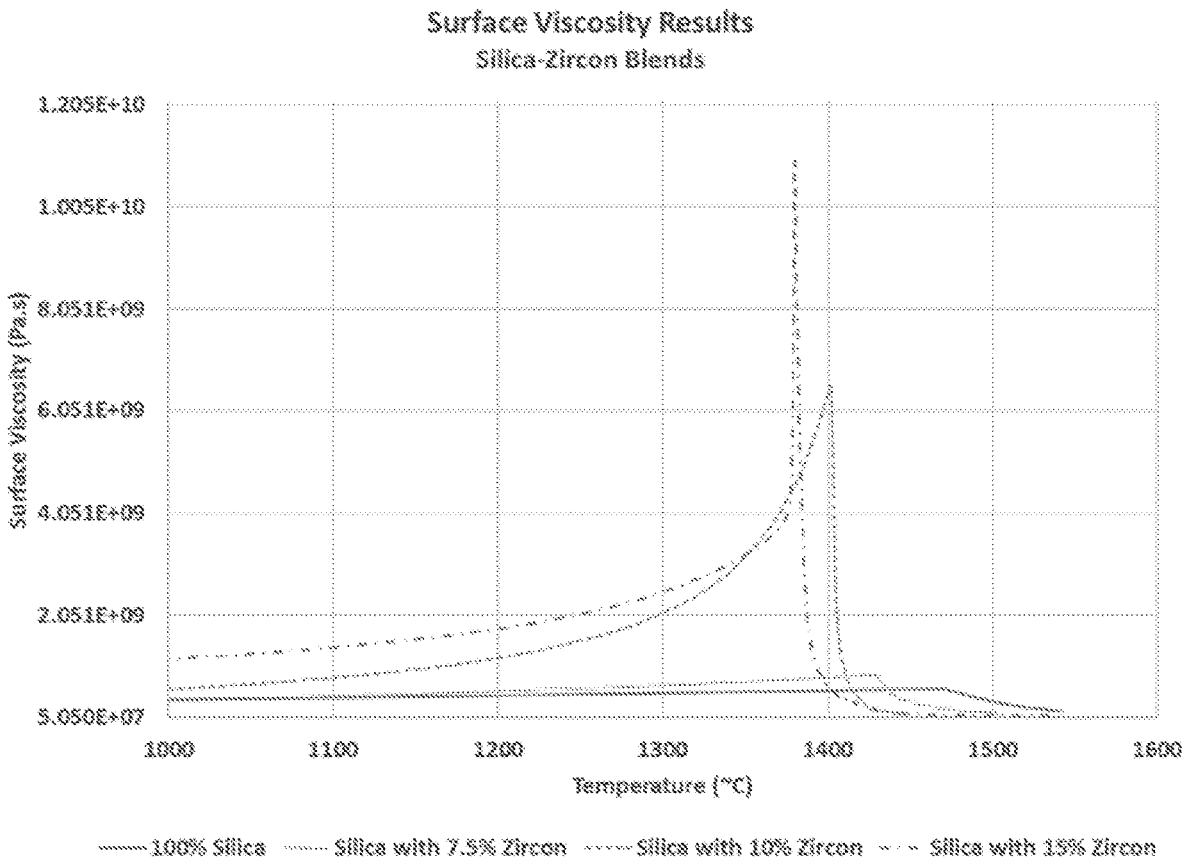
FIG. 11: Graph of surface viscosity vs. temperature for (a) silica, (b) silica blended with 7.5 wt % zircon, (c) silica blended with 10 wt % zircon, (d) silica blended with 15 wt % zircon.

FIG. 11 shows the surface viscosity results for the four samples at high temperatures. The temperature at which a sharp decrease in viscosity occurs is defined as the sinter temperature for the sample. The results show that the sinter temperature decreases with increasing zircon content. The baseline silica sample was measured to have a sinter temperature of 1469.9° C. (2677.8° F.). In comparison, the 7.5%, 10% and 15% zircon samples were observed to have sinter temperatures of approximately 1430° C. (2606° F.) to 1380° C. (2516° F.). Additionally, it can be seen that peak viscosity at the sinter temperature increases with increasing contents of zircon. The peak viscosity of the 10% and 15% zircon blends can be observed to be an order of magnitude or more higher.

Table 9 displays the peak expansion at alpha-beta phase transformation, sinter temperature and peak viscosity at sinter temperature for all samples.

TABLE 9

Expansion and viscosity characteristics

| Sample ID | Peak Expansion at Alpha-Beta Phase Transformation (in/in) | Sinter Temperature degrees C. | Peak Viscosity at Sinter Temperature (Pa · s) |
|---|---|---|---|
| 100% silica sand | 0.01203 | 1469.9 | 6.043 × 10^8 |
| Silica with 7.5% zircon | 0.01028 | 1430.0 | 8.897 × 10^8 |
| Silica with 10% zircon | 0.00870 | 1401.8 | 6.553 × 10^9 |
| Silica with 15% zircon | 0.00704 | 1378.8 | 1.101 × 10^10 |

In view of the above, increasing the content of zircon aggregate in the silica sand blend decreased the peak expansion at alpha-beta phase transformation while also lowering the temperature at which the cristobalite phase transformation occurred. Additionally, the sinter temperature of the samples decreased with increasing zircon content. Further, the peak viscosity at the sinter temperature increased by an order of magnitude or more for the 10% and 15% zircon samples.

Analysis of Step-Cone Castings

The step-cone cores were poured uncoated to evaluate the effectiveness of the zircon addition on eliminating the use of refractory coatings and improving the surface quality of grey iron castings. Table 10 shows the penetration index and ranking for the four samples for grey iron castings. A higher penetration index indicates a larger degree of penetration defects.

The extent of penetration defects was reduced greatly with the addition of zircon to silica sand. Baseline silica sand has a penetration index of 46.0. Silica with 7.5% and 10% zircon showed similar penetration indices while silica with 15% zircon was observed to have a penetration index of 8.0. It was also observed that the use of E2 zircon as an additive improved the surface quality of the castings substantially in the absence of a core coating.

TABLE 10

Penetration defects analysis results for grey iron castings

| Sample ID | Penetration Index | Penetration Rank |
|---|---|---|
| 100% Silica | 46.0 | 4 |
| Silica with 7.5% zircon | 14.5 | 3 |
| Silica with 10% zircon | 13.0 | 2 |
| Silica with 15% zircon | 8.0 | 1 |

With respect to grey iron castings, the addition of zircon to silica sand decreased the extent of penetration defects by a large amount.

Figure 12:
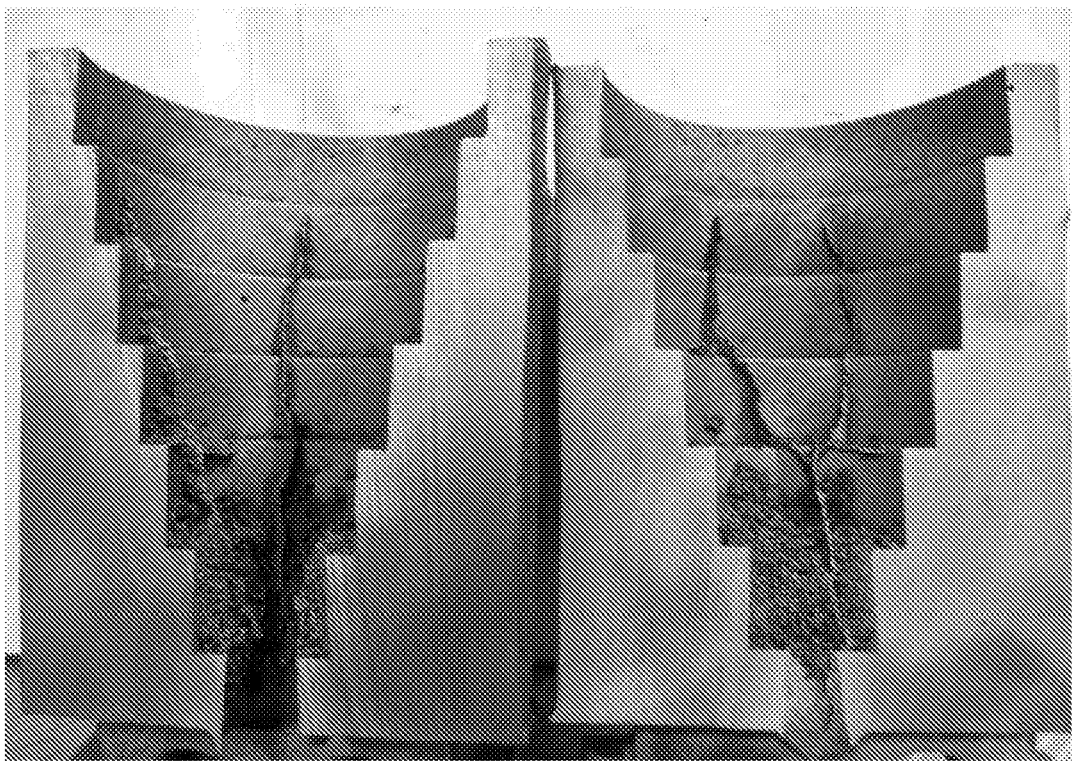
FIG. 12: Photograph of grey iron step-cone castings obtained using an uncoated core formed from silica sand.
Figure 13:
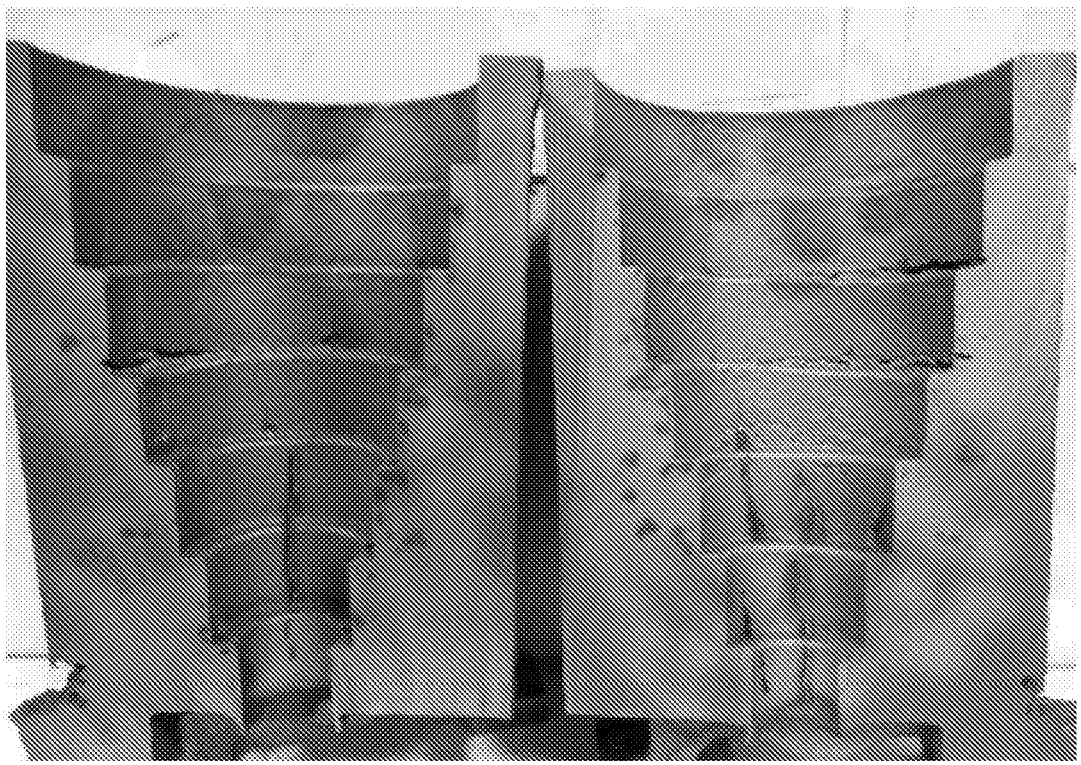
FIG. 13: Photograph of grey iron step-cone castings obtained using an uncoated core formed from silica sand blended with 7.5 wt % E2 zircon aggregate.
Figure 14:
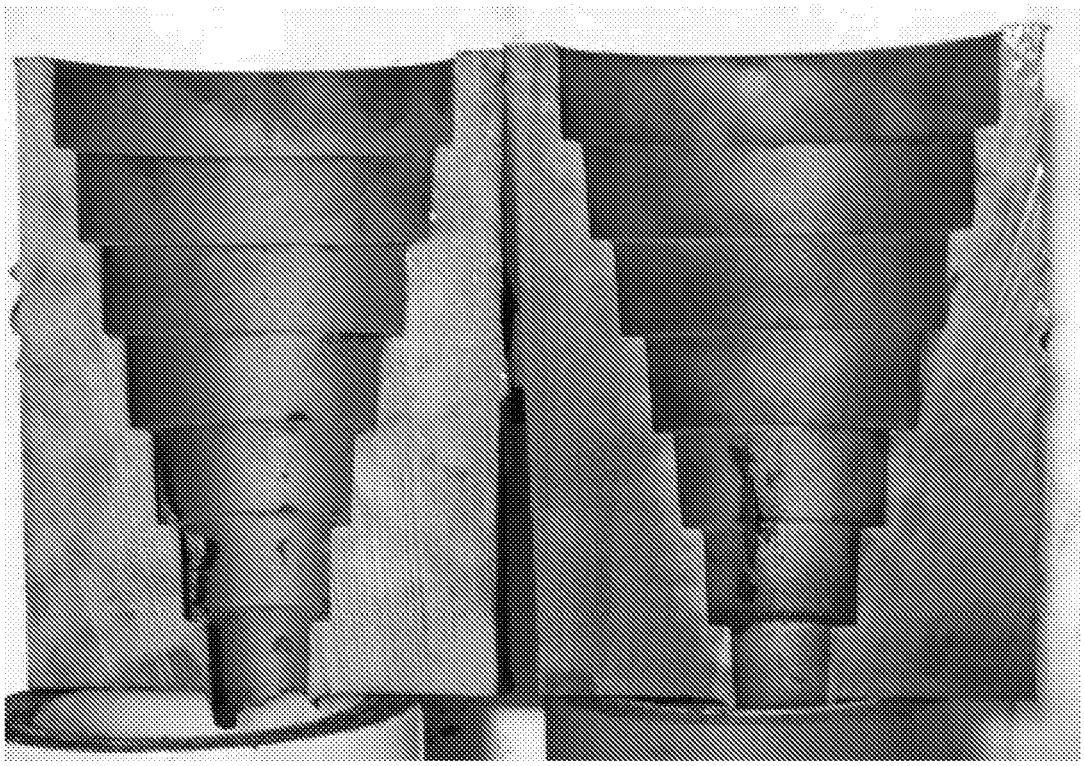
FIG. 14: Photograph of grey iron step-cone castings obtained using an uncoated core formed from silica sand blended with 10 wt % E2 zircon aggregate.
Figure 15:
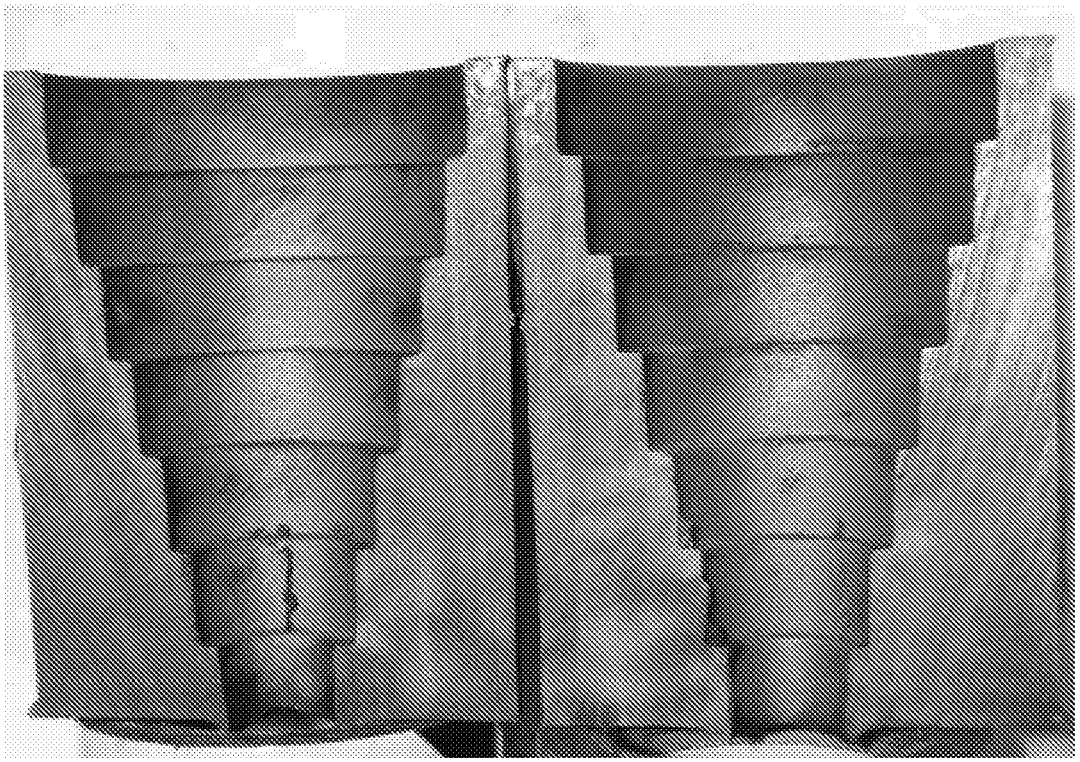
FIG. 15: Photograph of grey iron step-cone castings obtained using an uncoated core formed from silica sand blended with 15 wt % E2 zircon aggregate.

FIG. 12 is a photograph of a grey iron step-cone castings obtained using an uncoated core formed from silica sand. As can be seen, substantial defects are present in the uncoated core. FIG. 13, FIG. 14, and FIG. 15 are photographs of grey iron step-cone castings obtained using an uncoated core formed from silica sand blended with 7.5 wt % E2 zircon aggregate, 10 wt % E2 zircon aggregate, and 15 wt % E2 zircon aggregate respectively. From FIGS. 13, 14, and 15 it can be seen that the 7.5% zircon sample exhibited considerably lower penetration when compared to the baseline silica sample (see FIG. 12). The presence of defects decreased with increasing zircon content, with the 15% zircon sample exhibiting the best results.

It was also observed that the use of E2 zircon as a sand additive increased the surface quality of the iron castings by a large amount, though the step-cone cores were tested uncoated. This suggests that the E2 zircon can be used effectively as an additive to improve iron casting surface quality, without a need for a core/mould coating.

It will be understood that the invention disclosed and defined in this specification extends to all alternative combinations of two or more of the individual features mentioned or evident from the text or drawings. All of these different combinations constitute various alternative aspects of the invention.

The claims defining the invention are as follows:

1. A method of casting an article from a molten metal including:

admitting molten metal to a mould formed from a foundry sand comprising a blend of silica sand and a zircon aggregate, the zircon aggregate exhibiting a sharp increase in linear thermal expansion coefficient in a temperature band above 1200° C. and up to 1600° C.; and cooling the mould and molten metal to solidify the molten metal and form a cast article, wherein one or more surfaces of the mould, or of a portion of the mould, in contact with the molten metal are uncoated wherein the sharp increase in the linear thermal expansion coefficient is at least 0.008 in/in.

2. The method of claim 1, including:

forming the mould for the article from the foundry sand.

3. The method of claim 1, wherein the molten metal is admitted to the mould with a temperature that is at or above 1200° C.

4. The method of claim 1, wherein the sharp increase is at least 0.010 in/in.

5. The method of claim 1, wherein the sharp increase in the linear thermal expansion coefficient occurs in a temperature band of above 1200° C. and up to 1500° C.

6. The method of claim 5, wherein the temperature band is above 1200° C. and up to 1460° C.

7. The method of claim 1, wherein the zircon aggregate is such that the foundry sand blend exhibits a reduced magnitude of the linear thermal expansion coefficient at temperature corresponding to alpha-beta silica phase transition.

8. The method of claim 7, wherein the foundry sand blend exhibits a maximum linear thermal expansion value of less than 0.012 in/in over a temperature range of from 550° C. to 600° C.

9. The method of claim 8, wherein the peak or maximum linear thermal expansion value is less than 0.011 in/in.

10. The method of claim 1, wherein the zircon aggregate is such that the foundry sand blend exhibits a cristobalite silica phase transition which occurs at a lower temperature compared to silica foundry sand.

11. The method of claim 10, wherein the cristobalite silica phase transition occurs at a temperature below 1460° C.

12. The method of claim 1, wherein the foundry sand exhibits a local minimum in the linear thermal expansion value of less than 0.008 in/in at a temperature from 1200° C. to 1460° C.

13. The method of claim 1, wherein the foundry sand includes a proportion of the zircon aggregate in the range of from 5 wt % up to 40 wt %.

14. The method of claim 13, wherein the proportion of zircon aggregate in the blend is from 5 wt % up to 15 wt %.

15. The method of claim 1, wherein the zircon aggregate includes $Fe_2O_3$, $TiO_2$ and $Al_2O_3$ in a combined amount of from 2.0 wt % and up to 4.0 wt %.

* * * * *